United States Patent [19]

Jennings

[11] 4,089,769

[45] May 16, 1978

[54] PACKING GLAND FOR CELL TAPPING TUBE

[75] Inventor: Charles E. Jennings, Maryville, Tenn.

[73] Assignee: Aluminum Company of America, Pittsburgh, Pa.

[21] Appl. No.: 797,776

[22] Filed: May 17, 1977

[51] Int. Cl.[2] ..... C25C 3/00

[52] U.S. Cl. ..... 204/245; 204/64 R; 204/274; 204/279

[58] Field of Search ..... 204/245, 243–244, 204/64 R, 274, 279

[56] References Cited

U.S. PATENT DOCUMENTS

| | | | |
|---|---|---|---|
| 3,383,294 | 5/1968 | Wood | 204/64 R |
| 3,677,926 | 7/1972 | Davis | 204/245 |
| 3,729,397 | 4/1973 | Goldsmith et al. | 204/64 R |

*Primary Examiner*—John H. Mack
*Assistant Examiner*—D. R. Valentine
*Attorney, Agent, or Firm*—Daniel A. Sullivan, Jr.

[57] ABSTRACT

The invention is for placement in a molten salt electrolysis cell and a jacket means on the cell for providing a chamber for containment of a coolant. The cell and the jacket means have an orifice extending from the exterior of the jacket means into the interior of the cell. The invention, a tapping apparatus, includes a tapping tube in the orifice extending into the interior of the cell, and a packing tube and packing in the orifice and surrounding the tapping tube, with the improvement including the extending of the packing tube and packing past the jacket means.

2 Claims, 1 Drawing Figure

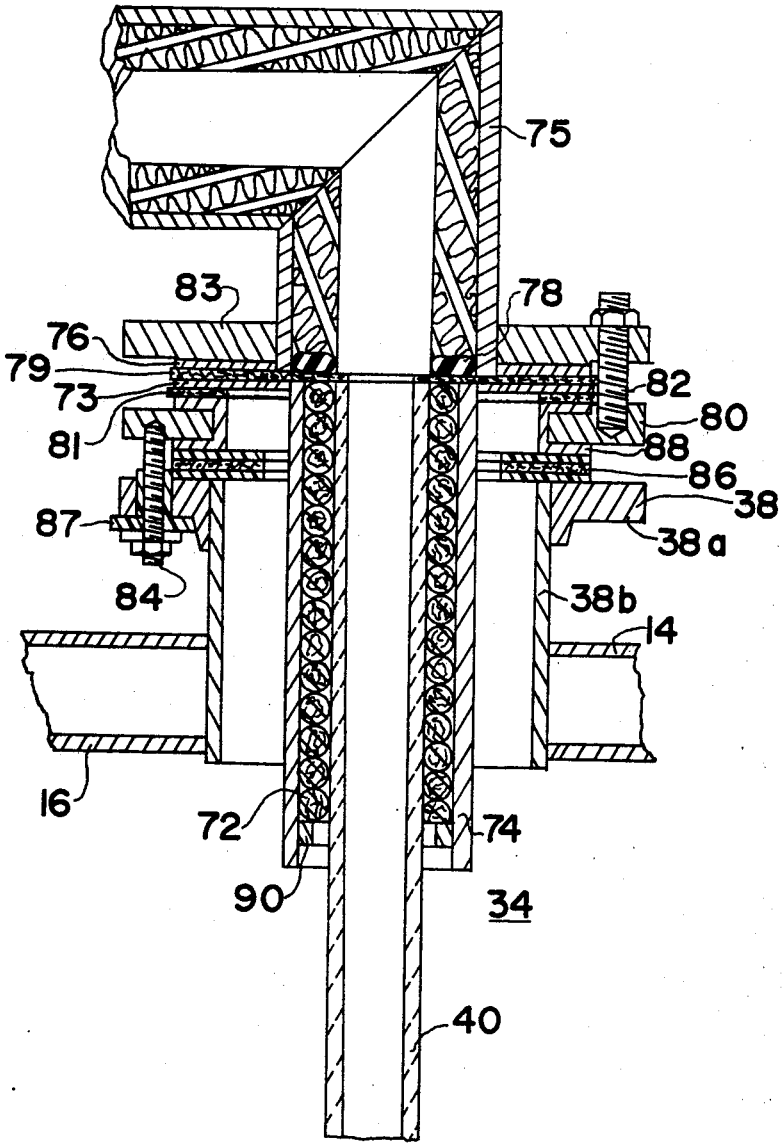
75
83
78
76
79
73
82
80
81
88
86
38
87
38a
84
38b
14
16
72
74
90
34
40

PACKING GLAND FOR CELL TAPPING TUBE

BACKGROUND OF THE INVENTION

The present invention relates to a tapping apparatus for a molten salt electrolysis cell, the term "tapping" referring to the removal of a product of the electrolytic process from the cell.

British Patent No. 687,758 of H. Grothe, published Feb. 18, 1953, shows a vacuum tapping tube 8 used in the tapping of molten aluminum product from a cell generating the aluminum by the electrolysis of aluminum chloride in a molten salt bath. In the use of such a technique for tapping cells based on those disclosed in U.S. Pat. No. 3,893,899 of M. B. Dell et al, issued July 8, 1975, for "Electrolytic Cell for Metal Production," considerable breakage of the quartz tapping tube was experienced.

SUMMARY OF THE INVENTION

In view of the problem as outlined in the background of the invention, it is an object of the present invention to provide a tapping apparatus resisting tapping tube breakage in the applications indicated above.

This as well as other objects which will become apparent in the discussion that follows, are achieved according to the present invention by providing a special tapping apparatus placed in a molten salt electrolysis cell and a jacket means on the cell for providing a chamber for containment of a coolant. The cell and jacket means have an orifice extending from the exterior of the jacket means into the interior of the cell. The tapping apparatus includes a tapping tube in the orifice extending into the interior of the cell. Additionally included is a packing tube and packing in the orifice and surrounding the tapping tube. The improvement of the tapping apparatus involves in its broad sense extending the packing tube and packing past the jacket means.

BRIEF DESCRIPTION OF THE DRAWING

The FIGURE is a sectional, elevational view of an embodiment of the present invention for tapping a cell.

DESCRIPTION OF THE PREFERRED EMBODIMENTS

With reference to the FIGURE, the essentials of a tapping apparatus according to the present invention are illustrated. The tapping apparatus may be used in conjunction with the cell of the above-mentioned U.S. Pat. No. 3,893,899. With reference to FIG. 1 of that patent, lid 9 of that patent corresponds to lid 16 in the present the FIGURE while port 10 there corresponds to port 38 here. The cell partially illustrated here, however, has been modified with respect to that shown in U.S. Pat. No. 3,893,899 to the extent that water cooling is provided on the top of lid 16 here and the refractory roof 8 of that patent has been eliminated here. Thus, cooling jacket 14 covers the lid 16 of the cell. And, lid 16 is exposed directly to chlorine and salt vapors and is made of a suitably chlorine resistant metal such as the alloy nominally containing 80% Ni, 15% Cr, and 5% Fe and sold under the trademark Inconel. All water pipes running to and from the cooling jacket are provided with rubber hose electrical breaks, so that electrical current cannot move to or from the cell along the otherwise metallic pipes.

The cell cavity also includes a bath reservoir 34 (corresponding to reservoir 7 in U.S. Pat. No. 3,893,899) in its upper zone. The tapping port 38 provides an orifice extending through the lid 16 into bath reservoir 34 for insertion of the vacuum tapping tube 40 forming part of the present invention. Port 38 is made of the above-mentioned alloy sold under the trademark Inconel.

Port 38 is, in this embodiment, constructed of a flange section 38*a* and pipe section 38*b*. As indicated above, port 38 provides an orifice extending from the exterior of jacket 14 into the bath reservoir 34 in the interior of the cell. Disposed within this orifice is vacuum tapping tube 40 of e.g. quartz, surrounded by asbestos rope packing 72 in packing tube 74. The packing is of sufficient length, as measured along the axis of tube 40, that it extends past the coolant chamber formed between the jacket 14 and the cell lid 16. The packing also extends along the quartz tube at least 9 inches, e.g. 12 to 15 inches, to provide protective bearing surface against the quartz tube. This packing acts to insulate the quartz tapping tube from the coolant within jacket 14 and to cushion the tube, in order to prolong its life.

A tapping snout 75, internally insulated as indicated schematically, with an end ring 78 of refractory ceramic material, and equipped with a flange 76, fits over gasket 79 onto the flange 73 of packing tube 74 and is fastened to ring 80 by bolts 82 (only one being shown for ease of illustration) passing through hold-down collar 83. A gasket 81 is interposed between flange 73 and ring 80. The ring 80 is secured to tapping port 38 by bolts 84 (only one being shown for ease of illustration) with the interposition of gasket 86. The bolts 84 are sealed in electrically insulating plastic bushing/washer combinations 87, of e.g. a thermoset plastic material, in order to better electrically isolate the cell from snout 75. A suitable thermoset plastic material is made from fabric or paper impregnated with phenol-formaldehyde resin, for instance the material supplied under the trademark Micarta by Westinghouse Electric Corp.

While gaskets 79 and 81 are simple asbestos-based gaskets, gasket 86 is constructed of two sheets of polytetrafluoroethylene with an interposed sheet of the asbestos-based material used for gaskets 79 and 81, this sandwich structure being cut in an annular shape. As will be apparent from the drawing, gasket 86 extends inwards to within e.g. 1/16-inch, or less, from tube 74 and is thus in effect cantilevered with its outer annular portion clamped and its inner annular portion extending radially inwards into free space. The polytetrafluoroethylene surfaces are not wet by condensed vapors from the molten bath. Consequently, this cantilevered gasket forms a barrier to prevent a continuous film of condensate which could otherwise short circuit the lid 16 (which usually becomes anodic) with the molten aluminum (at cathode potential) in snout 75. It is because gasket 86 is relatively expensive and must be made, and secured in place, just right so as to preclude short circuiting, that ring 80 is provided. In this way, the snout can be removed, for example for replacement of quartz tube 40, without disturbing the previous securement of gasket 86.

The packing tube 74 is made of a chlorine resistant alloy, for example the above-mentioned alloy sold under the trademark Inconel. The facing 88 of ring 80 may be made of the same material.

The packing tube 74 is essentially of a length sufficient to accommodate the asbestos rope packing 72. The higher heat conductivity of tube 74, by the fact that it is metal, is beneficial for additionally protecting the quartz tube 40 from exposure to the coolness caused by the coolant within jacket 14. Thus, the temperature of the packing tube portion opposite the coolant within jacket 14 is higher than the corresponding portion of the asbestos rope would be, if it were exposed directly to the coolant, this because of the higher heat conductivity of the metal as compared to that of the asbestos rope.

The packing tube may have a constriction at its lower end. For example, internal flange 90 serves to retain the lower side of asbestos rope packing 72. The inner diameter of flange 90 is chosen a little larger than the outer diameter of tube 40 — perhaps by ¼ inch — in order to prevent the possibility of flange 90 inadvertently bearing against tube 40.

The entire tapping assembly is put in place before the cell is started up. The quartz tube protrudes into the sump (not shown) of the cell. In tapping, a vacuum is drawn in a molten metal holding vessel (not shown) connected to snout 75, and this causes metal to be sucked out of the sump of the cell, up through tube 40, through snout 75, and into the metal holding vessel.

It will be understood that the above description of the present invention is susceptible to various modifications, changes, and adaptations and the same are intended to be comprehended within the meaning and range of equivalents of the appended claims.

What is claimed is:

1. In a molten salt electrolysis cell and a coolant chamber on the cell, said cell and coolant chamber having an orifice extending therethrough from the exterior of the coolant chamber into the interior of the cell, a tapping apparatus including a tapping tube in the orifice extending into the interior of the cell, and a packing tube and packing in the orifice and surrounding said tapping tube, wherein the improvement comprises the extending of the packing tube and packing past the coolant chamber.

2. In a cell and jacket means as claimed in claim 1, wherein the tapping apparatus has the further improvement that the packing tube and packing extend at least 9 inches along the tapping tube.

* * * * *

UNITED STATES PATENT AND TRADEMARK OFFICE

CERTIFICATE OF CORRECTION

PATENT NO. : 4,089,769

DATED : May 16, 1978

INVENTOR(S) : Charles E. Jennings

It is certified that error appears in the above-identified patent and that said Letters Patent are hereby corrected as shown below:

Col. 1, line 54 After "present" delete "the".

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*